United States Patent [19]

Calvert

[11] 4,281,826

[45] Aug. 4, 1981

[54] STILE AND RAIL CLAMP

[76] Inventor: Royce M. Calvert, 1207 Alturas, Wichita, Kans. 67216

[21] Appl. No.: 103,704

[22] Filed: Dec. 14, 1979

[51] Int. Cl.[3] ..... B25B 1/20

[52] U.S. Cl. ..... 269/41; 269/154; 269/155; 269/246

[58] Field of Search ..... 269/37, 40, 41, 42, 269/45, 246, 321 S, 104, 110, 152–155, 97–98; 248/226.4; 24/263 A

[56] References Cited

U.S. PATENT DOCUMENTS

| | | | |
|---|---|---|---|
| 242,959 | 6/1881 | Naglee | 269/156 |
| 759,560 | 5/1904 | Sharp | 248/226.4 |
| 1,546,583 | 7/1925 | Hunter | 269/97 |
| 1,987,826 | 1/1935 | Heumann | 269/98 |
| 2,606,583 | 8/1952 | O'Connor | 269/41 |
| 3,663,004 | 5/1972 | Hupert | 269/321 S |
| 3,914,871 | 10/1975 | Wolff | 269/41 |
| 4,093,202 | 6/1978 | Kincaid | 269/321 S |
| 4,141,542 | 2/1979 | Wolff | 269/155 |
| 4,165,869 | 8/1979 | Williams | 269/154 |

*Primary Examiner*—Robert C. Watson

*Attorney, Agent, or Firm*—Robert E. Breidenthal

[57] ABSTRACT

A stile clamp provided with a first clamp manually operable to hold a rail against a base, and a second clamp operable in a direction perpendicular to that of the first clamp to force a stile against the held rail. The first clamp and the base have mutually perpendicular surfaces, which facilitate proper orientation of the rail and the stile before operation of the clamps fixes their positions.

6 Claims, 4 Drawing Figures

FIG. 1
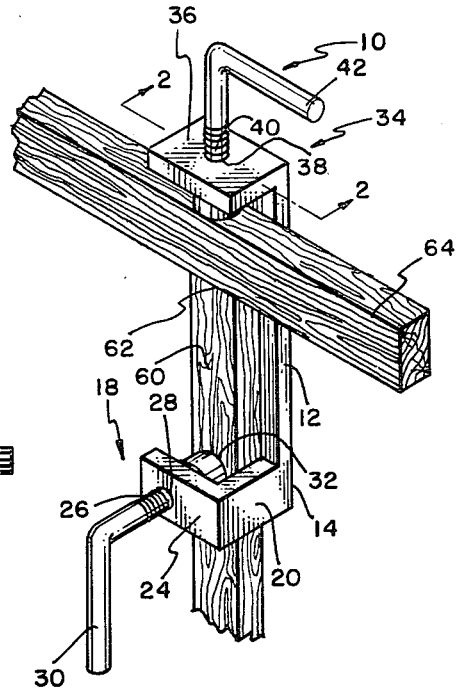
FIG. 2
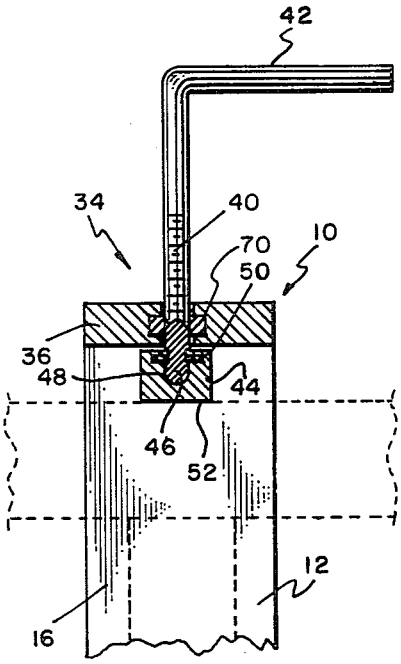
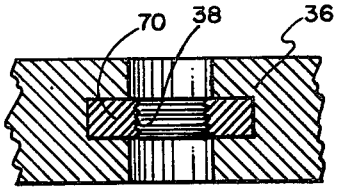
FIG. 4
FIG. 3
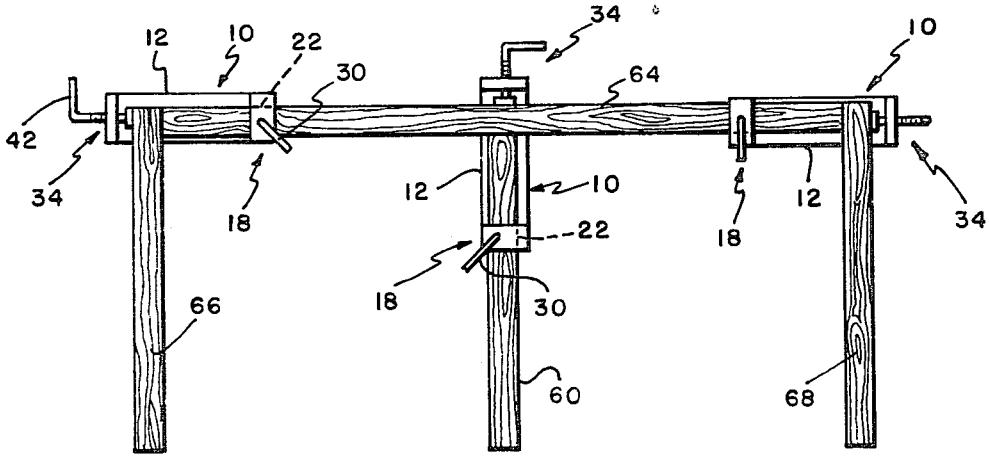

STILE AND RAIL CLAMP

The present invention relates to hand tools of the type used by cabinet makers for the holding of components during the joining thereof by the use of adhesives, and more particularly pertains to a clamping tool especially well suited for use in the joining or bonding of stiles and rails together.

Numerous tools inclusive of clamps have been heretofore proposed and marketed for use in securing rails and stiles together as they are being adhesively secured together. However, none of such devices of the prior art have been entirely satisfactory. Among prominent deficiencies of such prior art devices may be mentioned that their use scars or mars the pieces to an objectionable extent requiring excessive time and labor to repair, and extraneous devices (squares and the like) must or should be used to orient properly the parts. The tools are large and cumbersome so as to make precise work difficult, and tend to be conducive to slipshod work by skilled craftsmen. Also prior art devices frequently require the coordinated efforts of two or more workers to perform necessarily simultaneous tasks at locations that are remote from each other.

The paramount objective of the instant invention is to obviate the prior art deficiencies alluded to above, and more specifically to provide a small and easily manipulatable and operable stile clamp that presents only planar surfaces to the parts so as to have a minimal marring effect in use.

An important objective of the invention is to provide a clamp such that forces applied thereby act through such short distances so as to cause no significant compressive bowing or bending.

Another very important object of the invention is to provide a clamp such that the various clamping operations that must be performed at locations remote from each other, as along a rail, can be performed sequentially and hence by a single craftsman.

Yet another object is to provide a stile clamp which includes planar surfaces that materially aid in appropriately orienting a part to the clamp itself as well as to the part to be joined thereto.

A final objective to be specifically enumerated resides in providing an economical as well as durable stile clamp with which the relatively unskilled craftsman can quickly become adept in its use.

A broad aspect of the invention involves a stile clamp comprising a base having a horizontal and planar surface adapted to receive thereagainst workpieces to be joined, a manually operable holding means carried by the base for releasably holding a workpiece against said planar surface, said holding means including a holding foot spaced above and mounted for vertical movement perpendicular to the planar surface, said holding foot having a planar lower surface adapted to bear against a workpiece, and a clamp means carried by the base for urging a workpiece along the planar surface of the base toward a position on the latter directly below said holding foot, said clamp means including a clamping foot disposed above and mounted for movement parallel to the planar surface of the base along a linear path directed toward a position directly below the holding foot, with said clamping foot having a vertical planar surface normal to said path and facing toward the holding foot, whereby the clamping foot is adapted, with respect to a pair of workpieces that may be received against the planar surface of the base, to clamp one of such workpieces against the other which the holding foot is adapted to hold against the base.

The realization of the above objectives as well as an appreciation of other important features and functions can be most readily effected upon considering the following description of a preferred embodiment of the invention, such description being given in conjunction with the accompanying drawings, wherein:

FIG. 1 is an isometric view of the stile clamp showing the same applied in the joining of an intermediate portion of a fragmentarily shown rail to the upper end of a fragmentarily shown stile, with hidden parts being shown in dashed outline;

FIG. 2 is an enlarged sectional detail view taken upon the plane of the section line 2—2 in FIG. 1 with the rail and stile being shown in dashed outline;

FIG. 3 is an elevational view showing the utilization of three of the clamps of the instant invention as applied to show the same applied in the joining of the center of a rail to a central stile and the joining of the opposite ends of the rail to end stiles; and, FIG. 4 is an enlarged fragmentary sectional detail view showing an embedded nut to effectively obtain a threaded opening.

Referring now to the drawings, wherein like numerals designate like parts throughout the various views, the numeral 10 designates the stile clamp generally, the same being comprised of a generally rectangular base 12 having a rectangular and planar bottom surface with an edge at 14.

The base 12 has an upper surface 16 that is planar and parallel to the bottom surface of the base 12.

A holding clamp means 18 is carried by the base 12 adjacent an end of the base 12 and comprises an upstanding member 20 integral with the base 12. For a purpose presently to be explained, the upstanding member 20 has a vertical inner planar surface 22 that is parallel to the lower surface edge 14 and faces the horizontal, upper base surface 16.

The upper end of the holding member 20 terminates in an integral horizontally extending flange 24 that is spaced directly above an end portion of the upper base surface 16.

The holding means 18 includes a vertical threaded shaft or stem 26 that threadingly extends through a threaded opening 28 through the flange 24. Means are provided for enabling manual turning of the shaft 26, which conveniently can take the form of the upper end of the shaft 24 being bent to define a handle 30 as shown. A foot or press plate 32 is swivelly and rotatably journaled on the lower end of the shaft 26. It will suffice for the moment that manual turning of the shaft 26 in opposite directions will serve to urge the foot 32 vertically directly toward and away from the base surface 16 along a path spaced from the vertical surface 22.

The stile clamp or device 10 also includes a clamping means 34 carried by the base 12 at the minor end of the latter remote from the holding means 18. The clamping means includes an upstanding wall 36 integral with the base 12 having a horizontal threaded opening 38 therethrough through which threadingly extends a horizontal threaded shaft 40.

The axis of the threaded shaft 40 is horizontal, spaced vertically intermediate the base 12 and the flange 24, parallel to the inner surface 22 of the member 20, and is coplanar with the axis of the vertical shaft 26. The end of the shaft 40 remote from the holding means 18 is provided with an integral, manually operable handle 42, and a foot or press plate 44 is swivelly and rotatably mounted on the other end of the shaft 40 by conventional means.

Conveniently the conventional means referred to above can comprise the shaft having a ball-like form 46 at its end that is received in a blind bore or socket 48 in the foot 44. The shaft end 46 is retained in the socket 48 by means of a split ring spring 50 mounted in the foot 44.

It will be understood that the foot 32 is attached to the shaft 26 in the same manner as the foot 44 is attached to the shaft 40.

The feet 32 and 44 each have another feature or significance in that each has a planar surface on its side remote from its respective shaft that is perpendicular to the shaft. Such feature common to the feet 32 and 44 is exemplified by the latter foot having a vertical planar surface 52 that is normal to the axis of the shaft 40 and therefore normal to the travel path of the foot 44 as it is moved by turning of the shaft 40.

The base 12 as well as the components 20, 24 and 36 integral or of unitary construction therewith can be metallic with aluminum being well suited. Such integral structure is such that it can be cast or molded without any necessity for machining to obtain sufficiently planar surfaces for the purposes herein described therefor. The integral structure can be cast of aluminum, die cast of appropriate zinc alloys, or injection molded of a suitable synthetic resin having a substantial content of glass fibers for enhanced strength and other desired mechanical properties.

It will be evident to those skilled in the art, especially in the light of the ensuing description of use of the tool, that the planar surfaces do not need to be continuous and it will normally suffice for the structure involved to be definitive of a plane so that a planar object or objects seated or placed thereagainst are constrained to a particular orientation of its planar surface relative to the tool 10.

As indicated above, no machining is required to obtain surfaces sufficiently planar for the herein described purposes of the use of the tool 10. Futhermore, it is preferred that the internal threading of the openings 28 and 38 be effected by incorporating internally threaded steel nuts within the integral body during the casting or molding thereof by techniques well known to those conversant with the casting and molding art, whereby no threading operation need be performed after the casting or molding of the integral body. The nut incorporated in the upstanding wall 36 to constitute the internally threaded portion of the opening 38 is designated at 70 in FIGS. 2 and 4. It will be understood that the internally threaded opening 28 in the flange 24 is similarly constituted.

The threaded shafts 26 and 40 together with their handles and feet are also metallic with aluminum or steel being preferred.

The use of the tool or stile clamp 10 will be readily understood. For the purpose of the following description, it will be assumed that the rails and stiles to be joined are of rectangular parallelepiped configuration, that is, they have external configurations defined by planar surfaces, each of which is either parallel to or perpendicular to all the others.

Referring to FIG. 1, a rail 60 is disposed to seat two of its mutually perpendicular sides against the mutually perpendicular surfaces 16 and 22 of the tool. This serves to orient the end 62 of the stile directly toward the clamping means 34. The end 62 is disposed in the space between the holding means 18 and the clamping means 34, and it will be observed that the end face of the stile is parallel to the surface 52 of the foot 44.

The stile 60 is held fixed in the described orientation by manual turning of the shaft 26 to cause the planar surface of the foot 32 to bear against the stile 60 and forcefully hold the latter against the surface 16 of the base 12. The rotatable mounting of the foot 32 and the planar configuration of the latter minimizes any marring of the stile 60. If desired, or deemed expedient in this connection, the planar surfaces of the feet 32 and 44 can be provided with thin cushion layers of rubber or the like, not shown.

With the stile 60 held in its described orientation, the rail 64 is forcefully urged against the end 62 of the stile 60 by the foot 44 on turning of the shaft 40, with adhesive or glue having been applied to the mating surfaces of the stile 60 and rail 64. The orientation of the held stile 60 and the orientation of the planar surface 52 of the foot 44, together with the surface 16, coact in facilitating proper orientation of the rail 64 as will be appreciated.

It will be noted that the joining of the stile 60 and rail 64 as in FIG. 1 does not require any concurrent operations to be performed with respect to the rail 64 being joined to some additional stile.

FIG. 3 illustrates the use of three identical stile clamps 10 in joining the rail 64 to additional stiles 66 and 68. Although various orientations of rail and stiles are involved, the identical tools serve in each case without any of the same having to be inverted or turned upside down.

The invention and its use having been fully described, attention is now directed to the appended claims in order to ascertain the actual scope thereof.

I claim:

1. A stile clamp comprising a base having a horizontal and planar surface adapted to receive thereagainst workpieces to be joined, a manually operable holding means carried by the base for releasably holding a workpiece against said planar surface, said holding means including a holding foot spaced above and mounted for vertical movement perpendicular to the planar surface, said holding foot having a planar lower surface adapted to bear against a workpiece, and a clamp means carried by the base for urging a workpiece along the planar surface of the base toward a position on the latter directly below said holding foot, said clamp means including a clamping foot disposed above and mounted for movement parallel to the planar surface of the base along a linear path directed toward a position directly below the holding foot, with said clamping foot having a vertical planar surface normal to said path and facing toward the holding foot, whereby the clamping foot is adapted, with respect to a pair of wrokpieces that may be received against the planar surface of the base, to clamp one of such workpieces against the other which the holding foot is adapted to hold against the base, said holding means including an upstanding member having a vertical planar surface that extends above and faces toward the planar surface of the base in an arrangement such that such surfaces are mutually perpendicular, said planar surface facing and being parallel to the linear path of the clamping foot, whereby a workpiece of rectangular parallelepiped configuration can be oriented prior to the holding thereof by use of the mutually perpendicular surfaces so that a dimension thereof is normal to said linear path of the clamping foot.

2. The combination of claim 1, wherein said planar surface of the base is substantially rectangular in overall configuration, and wherein said member extends upwardly from the base from a position adjacent one end of the rectangular configuration, with the clamping means extending upwardly from the base from a position adjacent the other end of the rectangular configuration.

3. A stile clamp comprising a base having a horizontal and planar upper surface adapted to receive thereagainst workpieces to be joined, a manually operable-holding means mounted on the base for releasably holding a workpiece against said planar surface, said holding means including a holding foot spaced above and mounted for vertical movement perpendicular to the planar surface, with the space between the holding foot and the planar surface being free of any obstructions, said holding foot having a planar lower surface adapted to bear against a workpiece, and a clamp means mounted on the base for urging a workpiece along the planar surface of the base toward the space between said holding foot and the planar surface, said clamp means including a clamping foot disposed above and mounted for movement parallel to the planar surface of the base along a linear path directed toward said space between the holding foot and the planar surface, with said clamping foot having a vertical planar surface normal to said path and facing toward said space, whereby the clamping foot is adapted, with respect to a pair of workpieces that may be seated in coplanar relationship against the planar surface of the base, to clamp one of such workpieces against the other that the holding foot holds against the base, said base being elongated and having first and second ends and said holding means being a threaded means inclusive of a vertical threaded shaft provided at its upper end with means for enabling manual turning of the same, with said holding foot being rotatably mounted on the lower end of the shaft, said holding and clamp means being disposed respectively adjacent the first and second ends of the base, with said threaded means of the holding means being carried by an upstanding member fixed to the base at a position adjacent the first end of the latter and which is horizontally spaced from alignment with the linear path of the clamping foot.

4. The combination of claim 3, wherein said clamping means is a threaded means inclusive of a horizontal threaded shaft, means on an end of the horizontal shaft remote from the holding means enabling manual turning of the same, with said clamping foot being rotatably mounted on the other end of the horizontal shaft.

5. A stile clamp comprising a base having a horizontal and planar upper surface adapted to receive thereagainst workpieces to be joined, a manually operable holding means mounted on the base for releasably holding a workpiece against said planar surface, said holding means including a holding foot spaced above and mounted for vertical movement perpendicular to the planar surface, with the space between the holding foot and the planar surface being free of any obstructions, said holding foot having a planar lower surface adapted to bear against a workpiece, and a clamp means mounted on the base for urging a workpiece along the planar surface of the base toward the space between said holding foot and the planar surface, said clamp means including a clamping foot disposed above and mounted for movement parallel to the planar surface of the base along a linear path directed toward said space between the holding foot and the planar surface, with said clamping foot having a vertical planar surface normal to said path and facing toward said space, whereby the clamping foot is adapted, with respect to a pair of workpieces that may be seated in coplanar relationship against the planar surface of the base, to clamp one of such workpieces against the other that the holding foot holds against the base, said clamp means and said holding means being mounted on the base at positions that are remote from each other, and the position of mounting of the holding means on the base being horizontally spaced from alignment with the travel path of the clamping foot.

6. The combination of claim 2, wherein said rectangular configuration has an edge that is parallel to the vertical planar surface of said member.

* * * * *